US006589704B2

(12) United States Patent
Jensen et al.

(10) Patent No.: US 6,589,704 B2
(45) Date of Patent: Jul. 8, 2003

(54) COLOR ELECTROPHOTOGRAPHIC PROCESS AND APPARATUS

(75) Inventors: C. Troy Jensen, Caldwell, ID (US); David M. Payne, Star, ID (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 0 days.

(21) Appl. No.: 10/002,846

(22) Filed: Nov. 14, 2001

(65) Prior Publication Data

US 2003/0091917 A1 May 15, 2003

(51) Int. Cl.[7] ..... G03G 9/09
(52) U.S. Cl. ..... 430/124; 399/310; 430/126
(58) Field of Search ..... 430/45, 46, 97, 430/108.1, 124; 399/310

(56) References Cited

U.S. PATENT DOCUMENTS

| | | | | | |
|---|---|---|---|---|---|
| 4,113,482 | A | | 9/1978 | Wells | 96/1 PS |
| 4,399,289 | A | | 8/1983 | Imamura et al. | 548/507 |
| 4,803,144 | A | | 2/1989 | Hosoi | 430/106.6 |
| 4,908,301 | A | * | 3/1990 | Grosso et al. | 430/45 |
| 5,015,549 | A | * | 5/1991 | Grosso et al. | 430/45 |
| 5,045,420 | A | * | 9/1991 | Hosono et al. | 430/45 |
| 5,115,304 | A | | 5/1992 | Yoshikawa et al. | 358/75 |
| 6,093,529 | A | | 7/2000 | Tsuzuki et al. | 430/619 |
| 6,210,869 | B1 | | 4/2001 | Ito | 430/350 |

* cited by examiner

*Primary Examiner*—John Goodrow

(57) ABSTRACT

A process and apparatus are provided for printing particles of a color toner that is selectively colored and can demonstrate or reflect color based upon exposure to light of known wavelength, intensity, and duration. The color toner is sensitive to a plurality of wavelengths to provide a desired color. The apparatus performs three basic functions: (1) applies the toner to a print medium, using an electrophotographic process, requiring the toner to be chargeable; (2) selectively applies light to the toner, the light being of known wavelength, intensity, and duration, to convert the toner particles to the desired color(s); and (3) bonds or attaches the toner to the print medium. Since the color toner includes all necessary colors that are selectively activated, only one color toner and thus only application of one color toner is required. The process (1) increases the robustness of color image processing and mechanically simplifies the process of application and (2) results in high quality, time-enduring images.

20 Claims, 1 Drawing Sheet

COLOR ELECTROPHOTOGRAPHIC PROCESS AND APPARATUS

CROSS-REFERENCE TO RELATED APPLICATION

The present application is related to application Ser. No. 10/002,379, filed on even date herewith. That application is directed to the photosensitive color toner used in the electrophotographic process and apparatus disclosed and claimed herein.

TECHNICAL FIELD

The present invention is directed generally to electrophotographic printing, and, more particularly, to a process for printing a novel toner that contains a combination of color-sensitized silver halide crystals, developing agents, color coupling agents, and, optionally, fixing agents.

BACKGROUND ART

Color photography is a well-developed process. However, while the resultant colors are reasonably stable, no process has been developed to print computer-generated color images. Even so-called "instant" photography has not found use in printing computer-generated images, for example.

Briefly, in the general photographic process steps, light is directed to a silver halide (AgX) grain center. The silver halide crystal absorbs incoming energy and becomes excited (electron moves from the valence band to the conduction band). The silver halide crystal then draws an electron from the developer agent, e.g., p-phenylenediamine (PPD) and is therefore reduced (an electron is absorbed from PPD). The PPD developer is oxidized (due to the removal of the electron), leaving quinone-diimine (QDI). The QDI bonds with a color coupler or coupler ion to form an indoaniline or azomethine dye, depending upon chemistry choices. At the end of this reaction, dyes of the incident light color are created. It should be noted that each core containing color-sensitized silver halide crystals becomes colored to the wavelength it recognizes only, where the system or combination of cores then reproduces the incoming colors.

Any additional light will continue to be absorbed by AgX and continue reaction and creation of color dyes, ultimately creating black. Accordingly, the oxidation of PPD must be terminated at some point. This is accomplished by exciting the balance of unexcited AgX and saturating the AgX with electrons in a process known as "fixing". Reactions are halted, and a stable colored state is the result.

Color printing has emerged as an alternative to conventional silver halide photography. The attraction of color printing is substantially immediate production of the desired image.

Presently, a number of approaches to color printing have been developed: (1) ink jet technology, such as Hewlett-Packard's DeskJet printers, (2) dye sublimation, such as by thermal wax transfer, and (3) electrophotographic technology, such as Hewlett-Packard's LaserJet printers.

Color ink jet technology involves the expulsion of droplets of different colors of ink comprising colorants, or chromophores, in a vehicle. The expulsion is either from a controlled series of heated resistors or from a controlled series of piezoelectric elements. However, the chromophores are not as stable, or colorfast, as one would like, and images tend to fade over time. Further, waterfastness, smearfastness, and UV-fastness problems continue to be the focus of efforts of continuing improvements. While progress is being made, work continues in these areas.

An advantage of the dye sublimation process is that the dot intensity at a given location can be varied, without having to employ different inks (as in color ink jet printing) or without the lack of variation (as in color laser jet printing). However, the resolution is fairly limited, 300 dots per inch (dpi), for example.

Color electrophotographic technology employs color toners is an alternative technology to color ink jet technology. The former tends to be more expensive initially (in terms of printer cost), but less expensive over the long term, and in any event is faster. Further, colorfastness and image fade are not major issues as they are with ink jet printing. Nevertheless, typical electrophotographic processing requires multiple process steps and complex toner mixing. Further, typically, three colors of toners are used to produce the spectrum of colors. Each toner is applied with a separate EP process. The colors to be exhibited require careful application of each toner type to provide acceptable colors, Separate toner is used to provide monochrome black.

Briefly, in the general electrophotographic process steps, a laser (or other means, such as a light emitting diode) shines energy to a finite area on the electrophotographic drum, exciting the finite area on the drum coating. The drum is coated with a photovoltaic material that retains a charge once excited. Toner is stored in a toner cartridge hopper. The toner is agitated and electrostatically charged. A field generated by voltage differences propels the charged toner particles from region to region. The toner is attracted to the laser-charged finite area on the surface of the EP drum. The toner attached to the drum rotates toward a nip. A print medium is transported through the nip. The opposing roller in the nip is charged to attract the toner towards its surface and away from the EP drum. The print medium, located in the nip between the two rollers, is the receiver of the transported toner. As the print medium leaves the nip, the toner remains in place on the surface of the print medium. Finally, the toner is fused to the print medium, typically using both heat and pressure via a roller nip. In conventional processing, the toner is a plastic material having finite melting or glass transition temperatures. Fusing is a process of melting the toner into the fibers of the print medium.

A need remains for a color printing process that retains the advantages of the foregoing prior art approaches, while overcoming most, if not all, of their drawbacks. Since a novel color toner is disclosed and claimed in the above-referenced related application, there is a need for a process that effectively prints that toner and results in color photographic-quality imaging.

DISCLOSURE OF INVENTION

In accordance with the present invention, an apparatus and process are provided for printing particles of a color toner that can be selectively colored or that comprises particles that can demonstrate or reflect color based upon exposure to light of known wavelength, intensity, and duration. One preferred embodiment of the color toner is one that contains a combination of light-sensitive oxidizing agent(s), such as color-sensitive silver halide crystals, developing agent(s), color coupling agent(s), and, optionally, fixing agent(s).

The color toner, itself translucent prior to exposure to light, is capable of providing any of a number of selected colors, the particular color realized being dependent on the particular wavelength to which the particle is exposed. The toner may alternatively comprise a single color, such as for printing blue-prints, or may comprise a mixture of particles, each containing specific color-sensitized silver halide crystals, along with the various foregoing agents.

The apparatus and process of the invention essentially combine photographic and electrophotographic processes in a novel manner.

The apparatus for printing particles of the color toner comprises:

(a) a medium transport for transporting print media through the apparatus on which the toner particles are printed;

(b) a rotatable electrophotographic element;

(c) a light source, such as a laser, for shining radiation on a finite areas of the electrophotographic element, thereby charging the finite areas on the element;

(d) a light-tight source containing a quantity of the toner particles, which are attracted to the laser-charged finite areas on the surface of the electrophotographic element as the surface of the rotating element is passed through the toner source;

(e) a transfer roller urged against the electrophotographic element with sufficient pressure to form a nip through which the print medium is transported, the transfer roller being charged to attract the toner particles away from the electrophotographic element and onto the print medium;

(f) at least one light source for selectively exposing the toner particles to light of known wavelength, intensity, and duration to initiate (1) excitation of silver halide, (2) developer reaction, and (3) color coupler reaction;

(g) a fixing mechanism for fixing unexcited silver halide by saturating the unreacted silver halide with electrons and for terminating developer and color coupler reactions; and (h) a fuser for bonding the toner particles to the print medium.

The process of the present invention comprises:

(a) providing a print medium for transport through the apparatus of the present invention;

(b) developing an image by directing a laser or other source to shine energy to finite areas on the rotating electrophotographic element, thereby charging the finite areas on the element;

(c) passing the surface of the rotating electrophotographic element through the toner source to attract the toner particles to the laser-charged finite areas on the surface of the element;

(d) providing a charge to the transfer roller while the print medium is passed through the nip, thereby transferring the toner particles to the print medium by attracting the toner particles away from the electrophotographic element, the toner particles remaining on the print medium as the print medium leaves the nip;

(e) selectively exposing the toner particles by light of known wavelength, intensity, and duration;

(f) initiating (1) excitation of silver halide, (2) developer reaction, and (3) color coupling reaction;

(g) fixing the toner particles by (1) exciting the balance of unexcited silver halide and saturating the silver halide with electrons, (2) terminating the developer reaction, and (3) terminating the color coupling reaction; and (h) bonding the toner particles to the print medium.

Since the above-described color toner employed in the practice of the present invention includes all necessary colors that are selectively activated, only one color toner and thus only application of one color toner is required, thereby (1) reducing the application of multiple toner colors, (2) reducing the application of multiple color inks, (3) simplifying the toner processing, since selective application of "coloring", as opposed to chemical application, is employed, and (4) providing flexibility in producing color or monochrome images. Advantageously, toner may be selectively applied to image locations only, and then selectively exposed.

The resolution of the resulting print is similar to that of conventional photography, namely, about 3,000 dpi. This is in contrast to (1) color ink jet (1,700 dpi), (2) color dye sublimation (300 dpi), and (3) color laser jet (1,200 dpi).

The process of the present invention (1) increases the robustness of color image processing and mechanically simplifies the process of application and (2) results in high quality, time-enduring images.

BEST MODES FOR CARRYING OUT THE INVENTION

The process of the present invention is based on an electrophotographic (EP) process device, such as a laser printer, but employs a special toner, as described more fully in the above-referenced related application. That toner contains a combination of at least one light-sensitive oxidizing agent, such as color-sensitized silver halide crystals, at least one developing agent, at least one color coupling agent, and, optionally, at least one fixing agent.

Figure 1:
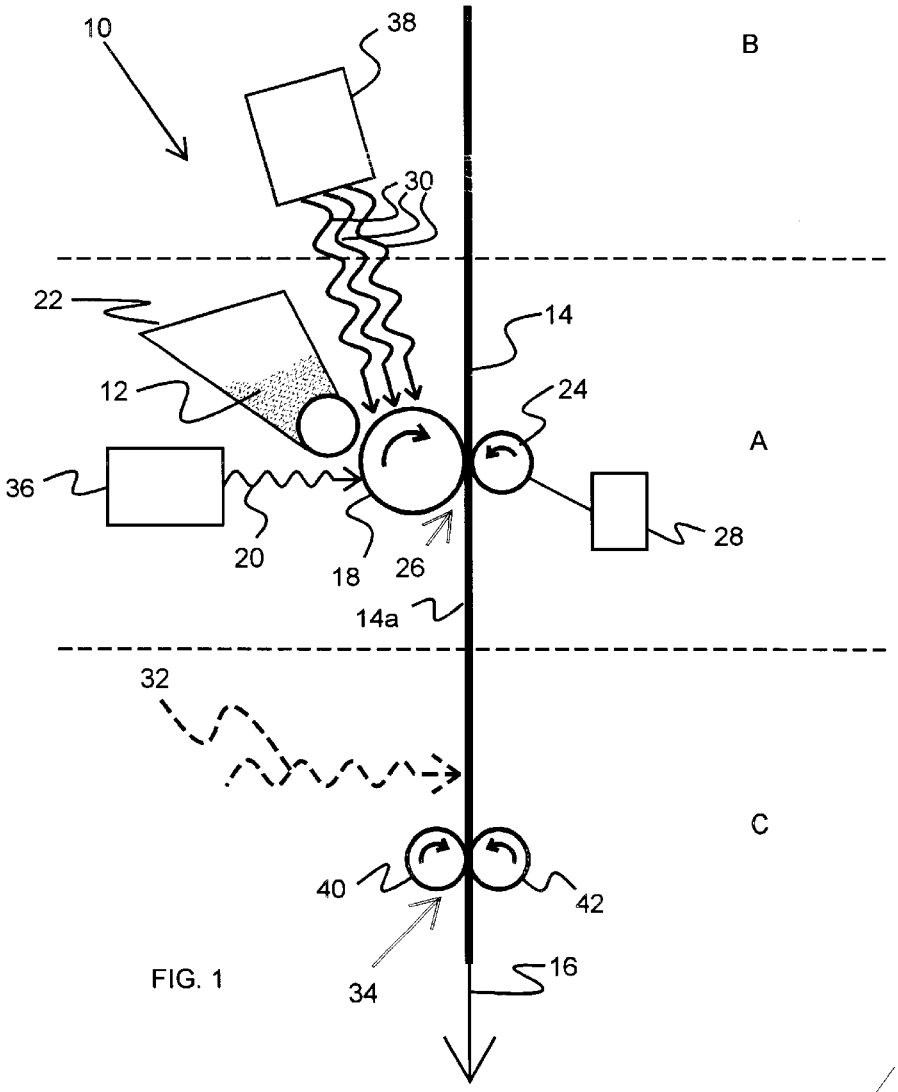
FIG. 1 is a schematic drawing depicting the process flow of the present invention and the apparatus elements that are part of that process flow.

With reference to FIG. 1, a printer 10 in accordance with the present invention is schematically depicted. The apparatus 10 for printing particles 12 of the color toner performs three basic functions:

(1) applies the toner to a print medium, using an electrophotographic process, requiring the toner to be chargeable (zone A);

(2) selectively applies light to the toner, the light being of known wavelength, intensity, and duration, to convert the toner particles to the desired color(s) (zone B); and (3) bonds or attaches the toner to the print medium (zone C).

The apparatus 10 of FIG. 1 depicts a preferred embodiment and comprises:

(a) a medium transport (not shown) for transporting print medium 14 through the apparatus 10 on which the toner particles 12 are printed, the print medium being moved in the direction indicated by the arrow 16;

(b) a rotatable electrophotographic element 18, such as a belt or drum;

(c) a light source 36, such as a laser, for shining radiation 20 on finite areas of the electrophotographic element 18, thereby charging the finite areas on the element;

(d) a light-tight source, or hopper, 22 containing a quantity of toner particles 12, which are attracted to the laser-charged finite areas on the surface of the electrophotographic element 18 as the surface of the rotating element is passed through the toner source 22;

(e) a transfer roller 24 urged against the electrophotographic element 18 with sufficient pressure to form a nip 26 through which the print medium 14 is transported, the transfer roller being charged by charging mechanism 28 to attract the toner particles 12 away from the electrophotographic element and onto the print surface 14*a* of the print medium;

(f) at least one light source 38 for exposing the toner particles 12 to light 30 of known wavelength, intensity, and duration to initiate (1) excitation of silver halide, (2) developer reaction, and (3) color coupler reaction;

(g) a fixing mechanism 32 for fixing unexcited silver halide by saturating the unreacted silver halide with electrons and to terminate developer and color coupler reactions; and (h) a fuser 34 for bonding the toner particles to the print medium.

The print medium 14 may comprise any of the print media commonly employed in printing of images, including, but not limited to, plain paper and coated paper, such as photographic paper. Preferably, the print medium 14 is continuously moved through the apparatus 10.

The hopper 22 must be light-tight in order to prevent exposure of the toner 12 to light prior to exposure by the light 30. In this connection, it will be clear that the interior of the apparatus 10 itself must be light-tight, at least during processing, so as to avoid exposure of the toner 12.

The element 18 is provided with a mechanism (not shown) for rotating the element during the printing process. The element 18 itself may comprise any of the materials commonly employed in electrophotographic printing, and may be a belt or drum, for example.

A laser 36 is commonly used to provide light energy 20 that is directed onto the finite areas of the rotating element 18. Other known light sources for electrophotographic processes, though not as preferred, may alternatively be used.

The light 30 directed onto the toner particles 12 on the surface the rotating element 18 is provided by a source 38, which may comprise a laser, cathode ray tube (CRT), light emitting diode (LED), or other means, such as filtered white light.

During the exposure of the toner particles 12 to the light 30, each toner particle represents color as dictated by exposure. Further details of the exposure process are provided below.

Fixing, as employed herein, is the act of artificially saturating the balance of unexcited silver halide crystals with electrons. During this fixing process, the unexposed silver halide crystals are excited and then reduced from external sources without reaction by the developing agents and color couplers. Fixing may be accomplished by optional fixing mechanism 32 via electronic bathing. Alternatively, the fixer may be included within the toner particles 14 and the fixing performed chemically.

Fusing, or bonding, the exposed toner particles 12 to the print medium 14 may be performed by a variety of techniques. Shown in FIG. 1 is a pressure mechanism, comprising two rollers 40, 42 and forming a nip 44. Alternatively, heat, infrared exposure, or other such means may be used to fuse the toner particles 12. Any combination of the foregoing techniques may also be employed.

It is possible that both the fixing and fusing steps may be performed simultaneously, in the same step, or in the same nip 44.

The composition of the toner 12 can be one that is selectively colored and can demonstrate or reflect color based upon exposure to light of known wavelength, intensity, and duration. Preferably, the composition of the toner 12 comprises a combination of light-sensitive oxidizing agent(s), such as color-sensitive silver halide crystals, developing agent(s), color coupling agent(s), and, optionally, fixing agent(s).

The color toner, itself translucent prior to exposure to light, is capable of providing any of a number of selected colors, the particular color realized being dependent on the particular wavelength to which the particle is exposed.

Figure 2:
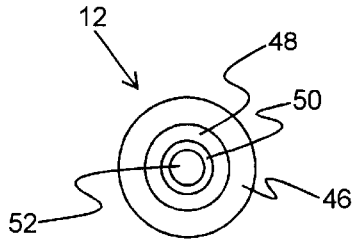
FIG. 2 is a schematic drawing, in cross-section, of a color toner particle employed in the practice of the present invention.

Turning now to FIG. 2, which depicts the preferred toner composition, each toner particle 12 employed in the practice of the present invention comprises multiple concentric spheres or cores 46, 48, and 50. The outermost sphere 46 contains blue-sensitive grain centers. The second sphere 48 contains green-sensitive grain centers. The third sphere 50 contains red-sensitive grain centers. An inner core 52 is required if using chemical fixing instead of electronic fixing. The fixing chemistry is isolated until ruptured or otherwise mixed with the outer layers 46, 48, 50.

Filters (not shown) may optionally be used between layers to isolate wavelengths. For example, a yellow filter (denoted 54 in FIG. 3) may be used between the green-sensitive layer 48 and the blue-sensitive layer 46.

Each sphere 46, 48, 50 includes a light-sensitive oxidizing agent, such as color-sensitive silver halide (AgX) crystals, one or more developing agents, and color coupling chemistry, all in a gelatin emulsion. Other components, such as anti-fog agents and hardeners, may also optionally be employed.

As noted above, each sphere 46, 48, 50 contains silver halide (bromide, chloride, or iodide) crystals. The individual crystals or grains can be called "grain centers". The silver halide crystals are doped with impurities to vary the excitation energy required from light, and is otherwise called "color-sensitized". Such impurity doping is well-known in conventional photographic processes.

The gelatin in each sphere may also be called a binder. The gelatin enhances, or increases the rate of, the oxidation and reduction reactions. Gelatin is a medium holding the property of colloid protection, or the ability to control crystal growth and maintain suspension. Gelatin is manufactured from the protein collagen, as is well-known.

Surrounding each grain center are one or more developing agents such as p-phenylenediamine (PPD) in a gelatin mixture also containing one or more color couplers.

Color couplers included in each sphere 46, 48, 50 may comprise (1) micelle-forming couplers, (2) polymeric couplers containing (a) vinyl groups, such as 2-vinyl-1-naphthol, (b) beta, gamma-ethylenically unsaturated amides, such as N-allylacetoacetamide, or (c) methacrylamide groups, such as 1-(m-methacyloylaminophenyl)-3-carboxy-5-pyrazolone, or (3) solvent dispersion couplers.

Yellow couplers may comprise, for example, open-chain active methylene groups (—$CH_2$—). PPD-active types include the beta-ketocarboxamides (benzoylacetanilides) or pivaloylacetanilides or pivaloyl groups producing azomethine dyes.

Magenta couplers may comprise, for example, active methylene groups in a heterocyclic ring. Most such compounds contain heterocyclic active methylene structures such as 5-pyrazolones (1-aryl-5-pyrazolones) created azomethine dyes.

Cyan couplers may comprise, for example, active methine groups in the para position of a phenol or naphthol. Typically, phenols or naphthols plus PPD yield indoaniline dyes.

While the additive color combination of yellow, magenta, and cyan is described above, the subtractive color combination of red, blue, and green may alternatively be used in the practice of the present invention. Further, variants of the foregoing colors may be used, depending on exposure to a specific wavelength.

In either case, black is achieved by simply exposing at all wavelengths and at high intensity.

Figure 3:
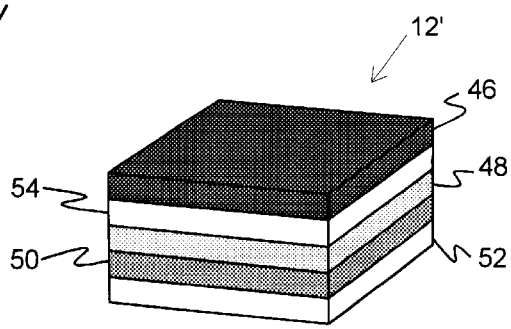
FIG. 3 is a schematic drawing, in perspective, of a preferred color toner particle employed in the practice of the present invention.

The foregoing description of the color toner particle has been presented in terms of spherical particles. From a practical point of view, however, it is likely that a "brick" shape, or layer-type, toner particle may be employed in the practice of the present invention, at least in initial commercial implementations. FIG. 3 schematically depicts such a particle 12'.

The color toner employed in the practice of the present invention has been described in terms of each particle containing all three colors (e.g., blue, green, and red). However, it may be desirable to provide a toner of only one color, such as blue for blueprints. Alternatively, in another embodiment, each toner particle comprises one color, rather than three colors, and the toner comprises a mixture of such single color toner particles.

The process of the present invention employs a new color toner material called Photosensitive Color Toner disclosed and claimed in the above-referenced related patent application, as briefly described above. The combination of the unique process and new color toner allows photographic-quality color imaging using a single toner. This process is, in essence, a hybrid between film photography and EP technology. This process uses only one "multi-color" toner material and one EP process per image or sheet.

In either case, a plurality of lasers, each set or tuned to the specific wavelength required to activate a specific color, is preferably employed to sensitize the toner particles, as shown by light 20. Alternatively, light emitted by light emitting diodes (LEDs) or a cathode ray tube (CRT) may be employed or even white light, passed through appropriate color filters, may be used to provide the specific wavelengths.

Industrial Applicability

The process and apparatus of the present invention are expected to find use in color printing.

What is claimed is:

1. A process for printing particles of a color toner that is selectively colored and can demonstrate or reflect color based upon exposure to light of known wavelength, intensity, and duration, said process comprising:

(a) providing a print medium for transport through a printing device;

(b) developing an image by directing a light source to shine energy to finite areas on a surface of a rotating electrophotographic element, thereby charging said finite areas on said surface of said electrophotographic element;

(c) passing said surface of said rotating electrophotographic element through a toner source to attract said toner particles to said laser-charged finite areas on said surface of said electrophotographic element, said toner particles being initially translucent and containing a combination of at least one light-sensitive oxidizing agent, at least one developing agent, at least one color coupling agent, and, optionally, at least one fixing agent;

(d) providing a charge to a transfer roller that forms a nip with said electrophotographic element while said print medium is passed through said nip, thereby transferring said toner particles to said print medium by attracting said toner particles away from said electrophotographic element, said toner particles remaining on said print medium as said print medium leaves said nip;

(e) selectively exposing said toner particles by light of known wavelength, intensity, and duration;

(f) initiating (1) excitation reactions, (2) developer reactions, and (3) color coupling reactions, as appropriate, in said toner particles, thereby providing a selected color dependent upon said wavelength;

(g) fixing said toner particles; and (h) bonding said toner particles to said print medium.

2. The process of claim 1 wherein said color toner comprises particles of one type, which provide a color dependent on exposure to a specific wavelength.

3. The process of claim 2 wherein said color toner provides additive or subtractive chromophores, or variants of such colors, depending upon said specific wavelength.

4. The process of claim 3 wherein said chromophores comprise a set of cyan, yellow, and magenta colors.

5. The process of claim 1 wherein said at least one light-sensitive oxidizing agent comprises color-sensitized silver halide crystals.

6. The process of claim 1 wherein said light source comprises a laser.

7. The process of claim 1 wherein said light of known wavelength, intensity, and duration is provided by at least one laser, at least one cathode ray tube, at least one light emitting diode, or filtered white light.

8. The process of claim 1 wherein said fixing is accomplished by bathing said at least one light-sensitive oxidizing agent with electrons via an electronic source of current or charge.

9. The process of claim 1 wherein said fixing is accomplished by including at least one fixing agent in said toner particles and rupturing or mixing said at least one fixing agent with pressure.

10. The process of claim 1 wherein steps (g) and (h) are carried out in a single step.

11. Apparatus for printing particles of a color toner is selectively colored and can demonstrate or reflect color based upon exposure to light of known wavelength, intensity, and duration, said apparatus comprising:

(a) a medium transport for transporting print media through said apparatus on which said toner particles are printed;

(b) a rotatable electrophotographic element;

(c) a light source for shining radiation on finite areas of said electrophotographic element, thereby charging said finite areas on said element;

(d) a source containing a quantity of said toner particles, which are attracted to said laser-charged finite areas on a surface of said electrophotographic element as said surface of said rotating element is passed through said toner source, said toner particles being initially translucent and containing a combination of at least one light-sensitive oxidizing agent, at least one developing agent, at least one color coupling agent, and, optionally, at least one fixing agent;

(e) a transfer roller urged against said electrophotographic element with sufficient pressure to form a nip through which said print medium is transported, said transfer roller being charged to attract said toner particles away from said electrophotographic element and onto said print medium;

(f) at least one light source for exposing said toner particles to light of known wavelength, intensity, and duration to initiate (1) excitation reactions, (2) developer reactions, and (3) color coupler reactions, as appropriate in said toner particles, thereby providing a selected color dependent upon said wavelength;

(g) a fixing mechanism for fixing said toner particles; and (h) a fuser for bonding said toner particles to said print medium.

12. The apparatus of claim 11 wherein said color toner comprises particles of one type, which provide a color dependent on exposure to a specific wavelength.

13. The apparatus of claim 12 wherein said color toner provides additive or subtractive chromophores, or variants of such colors, depending upon said specific wavelength.

14. The apparatus of claim 13 wherein said chromophores comprise a set of cyan, yellow, and magenta colors.

15. The apparatus of claim 11 wherein said at least one light-sensitive oxidizing agent comprises color-sensitized silver halide crystals.

16. The apparatus of claim 11 wherein said light source comprises a laser.

17. The apparatus of claim 11 wherein said light of known wavelength, intensity, and duration is provided by at least one laser, at least one cathode ray tube, at least one light emitting diode, or filtered white light.

18. The apparatus of claim 11 wherein said fixing mechanism comprises an electronic source for bathing said at least one light-sensitive oxidizing agent with electrons of current or charge.

19. The apparatus of claim 11 wherein said fixing mechanism comprises at least one fixing agent included in said toner particles and a mechanism for rupturing or mixing said at least one fixing agent with pressure.

20. The apparatus of claim 11 wherein elements (g) and (h) comprise a single element for said fixing and said bonding.

* * * * *